US007950468B2

(12) United States Patent
Horton

(10) Patent No.: US 7,950,468 B2
(45) Date of Patent: May 31, 2011

(54) WELLBORE PLUG

(76) Inventor: J. Dale Horton, Hominy, OK (US)

( * ) Notice: Subject to any disclaimer, the term of this patent is extended or adjusted under 35 U.S.C. 154(b) by 1 day.

(21) Appl. No.: 11/773,308

(22) Filed: Jul. 3, 2007

(65) Prior Publication Data

US 2008/0011479 A1 Jan. 17, 2008

Related U.S. Application Data

(60) Provisional application No. 60/818,870, filed on Jul. 6, 2006.

(51) Int. Cl.
*E21B 33/124* (2006.01)

(52) U.S. Cl. ..... 166/386

(58) Field of Classification Search ..... 166/386, 166/387, 123, 131, 133, 181
See application file for complete search history.

(56) References Cited

U.S. PATENT DOCUMENTS

| | | | | | |
|---|---|---|---|---|---|
| 3,189,096 | A * | 6/1965 | Fladger | 166/133 |
| 3,363,696 | A * | 1/1968 | Berryman | 166/334.4 |
| 3,420,305 | A * | 1/1969 | Alexander et al. | 166/114 |
| 3,570,595 | A * | 3/1971 | Berryman | 166/128 |
| 3,627,045 | A * | 12/1971 | Lebourg | 166/278 |
| 4,603,742 | A * | 8/1986 | Wong et al. | 166/374 |
| 4,648,445 | A * | 3/1987 | Caskey | 166/98 |
| 4,791,992 | A * | 12/1988 | Greenlee et al. | 166/387 |
| 4,967,845 | A * | 11/1990 | Shirk | 166/386 |
| 5,727,632 | A * | 3/1998 | Richards | 166/387 |
| 5,810,082 | A * | 9/1998 | Jordan, Jr. | 166/120 |
| 5,813,456 | A * | 9/1998 | Milner et al. | 166/135 |
| 5,921,318 | A * | 7/1999 | Ross | 166/250.17 |
| 6,131,663 | A * | 10/2000 | Henley et al. | 166/373 |
| 6,220,348 | B1 * | 4/2001 | Serafin et al. | 166/133 |
| 6,220,349 | B1 * | 4/2001 | Vargus et al. | 166/138 |
| 6,550,541 | B2 * | 4/2003 | Patel | 166/386 |
| 6,666,275 | B2 * | 12/2003 | Neal et al. | 166/386 |
| 6,926,088 | B2 * | 8/2005 | Tinker | 166/387 |
| 6,986,390 | B2 * | 1/2006 | Doane et al. | 166/285 |
| 7,036,602 | B2 * | 5/2006 | Turley et al. | 166/387 |
| 7,347,272 | B2 * | 3/2008 | Patel et al. | 166/373 |
| 2003/0024712 | A1 * | 2/2003 | Neal et al. | 166/386 |
| 2003/0188869 | A1 * | 10/2003 | Tinker | 166/301 |
| 2005/0039916 | A1 * | 2/2005 | Schultz et al. | 166/285 |
| 2005/0167097 | A1 * | 8/2005 | Sommers et al. | 166/136 |

* cited by examiner

*Primary Examiner* — David J Bagnell
*Assistant Examiner* — Blake Michener
(74) *Attorney, Agent, or Firm* — Winstead PC; Henry L. Ehrlich

(57) ABSTRACT

A method of retrieving at least a first plug and a second plug of the same type from a wellbore, wherein when the plugs are set in the wellbore each plug has a valve in a closed position blocking flow of fluid through the plug and a sealing mechanism expanded into engagement with a wellbore casing providing a seal between the plug and the casing, includes the steps of connecting a conveyance to the first plug; releasing the first plug; moving the first plug into connection with the second plug; and retrieving the first and the second plug from the wellbore simultaneously.

19 Claims, 3 Drawing Sheets

WELLBORE PLUG

RELATED APPLICATIONS

This application claims the benefit of U.S. Provisional Patent Application No. 60/818,870 filed Jul. 6, 2006.

FIELD OF THE INVENTION

The present invention relates in general to wellbore operations and more specifically to a multipurpose plug that facilitates circulation and retrieval of more than one multipurpose plug from the wellbore simultaneously.

BACKGROUND

It is common practice in the oil and gas industry to set a number of plugs in a wellbore. This commonly occurs when it is desired to separate various productions zones for stimulation such as fracturing or acid treatment. After stimulation the operator runs into the wellbore with tubing and circulates at the top of the uppermost plug to remove debris. The uppermost plug is then removed either by drilling the plug out or by releasing the plug and retrieving.

It is a therefore a desire to provide a multipurpose plug that facilitates circulating. It is a still further desire to provide a multipurpose plug that permits connections to other multipurpose plugs while facilitating circulation at the lowest most multipurpose plug in a manner that more than one multipurpose plug may be retrieved from the wellbore in a single trip.

SUMMARY OF THE INVENTION

In view of the foregoing and other considerations, the present invention relates to a wellbore plug and method wherein the plug can be retrieved from the wellbore without being drilled out, without applying tension or weight in combination with rotation, and facilitates the removal of multiple plugs simultaneously while circulating through the plugs.

A plug for use in a wellbore of the type having an internal bore formed through its length includes a valve actuatable to an open position allowing fluid flow through the internal bore; a mechanism for locking the valve in an open position; a sealing element that is urged outward from the internal bore into sealing engagement with a tubular positioned therearound; and a mechanism for securing the sealing mechanism in a retracted position wherein the sealing element is disengaged from the surrounding tubular.

A method of retrieving at least a first plug and a second plug of the same type from a wellbore, wherein when the plugs are set in the wellbore each plug has a valve in a closed position blocking flow of fluid through the plug and a sealing mechanism expanded into engagement with a wellbore casing providing a seal between the plug and the casing, includes the steps of connecting a conveyance to the first plug; releasing the first plug; moving the first plug into connection with the second plug; and retrieving the first and the second plug from the wellbore simultaneously.

A method of using a plug in a wellbore includes the steps of providing a first plug having a bore formed therethrough, a valve in operational connection with the bore and a casing sealing mechanism; setting the first plug in the wellbore with the valve in a closed position and the casing sealing mechanism engaging the casing; and retrieving the plug from the wellbore. The step of retrieving the plug includes connecting a conveyance to the plug; actuating the valve via the conveyance to the open position; locking the valve in the open position; actuating the casing sealing mechanism to a retracted position; and securing the casing sealing mechanism in the retracted position for retrieval from the wellbore.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
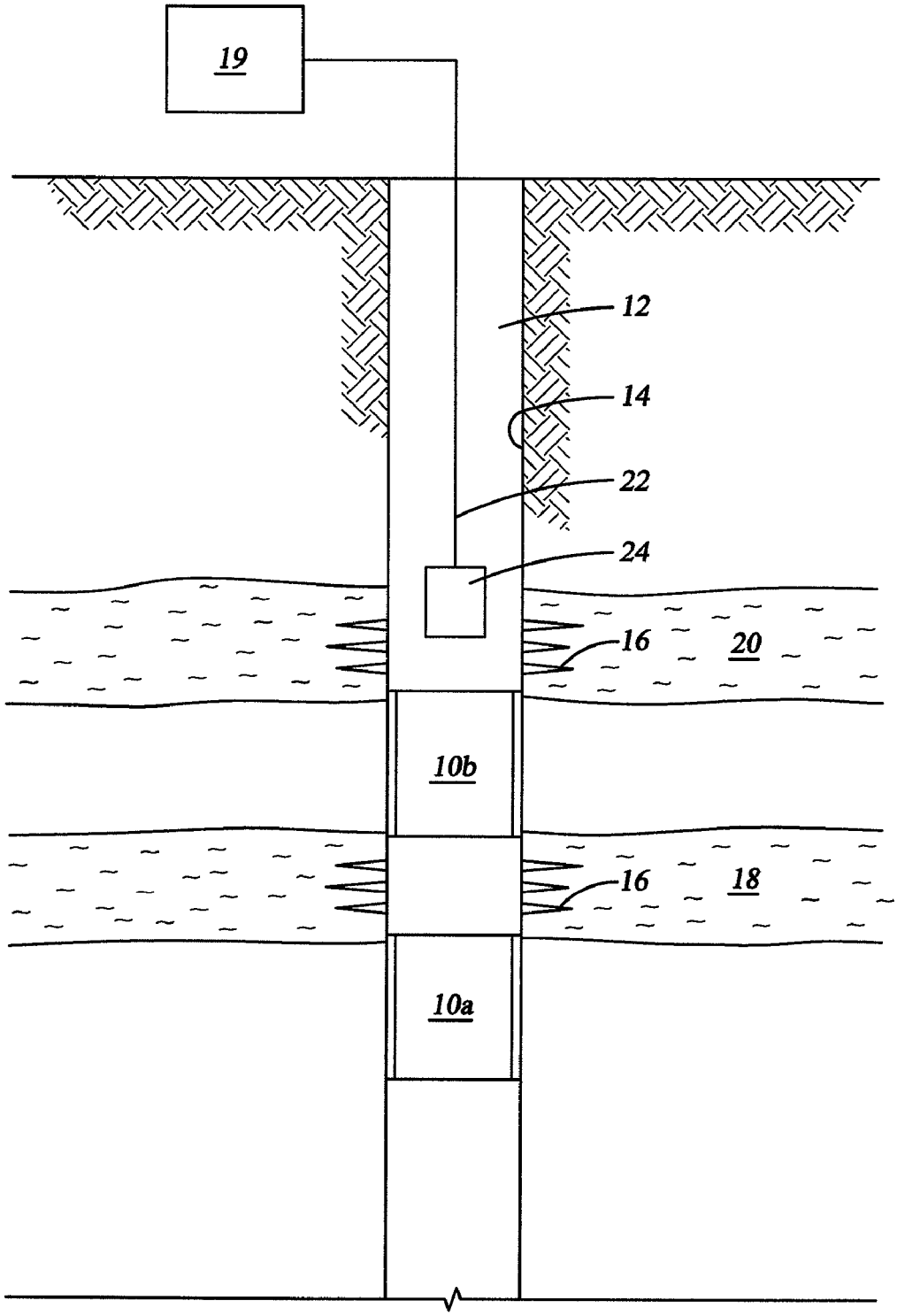
FIG. 1 is a wellbore schematic illustrating an aspect of the present invention.
Figure 2A:
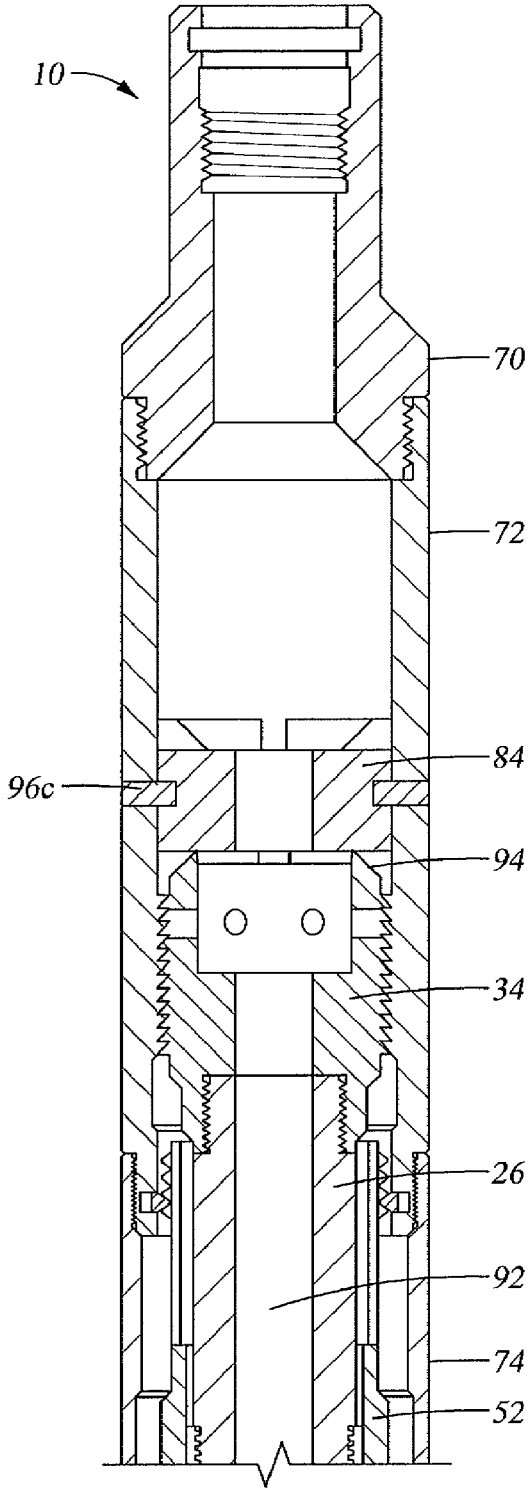
FIG. 2 is a cross-sectional view of a wellbore plug of the present invention.
Figure 2B:
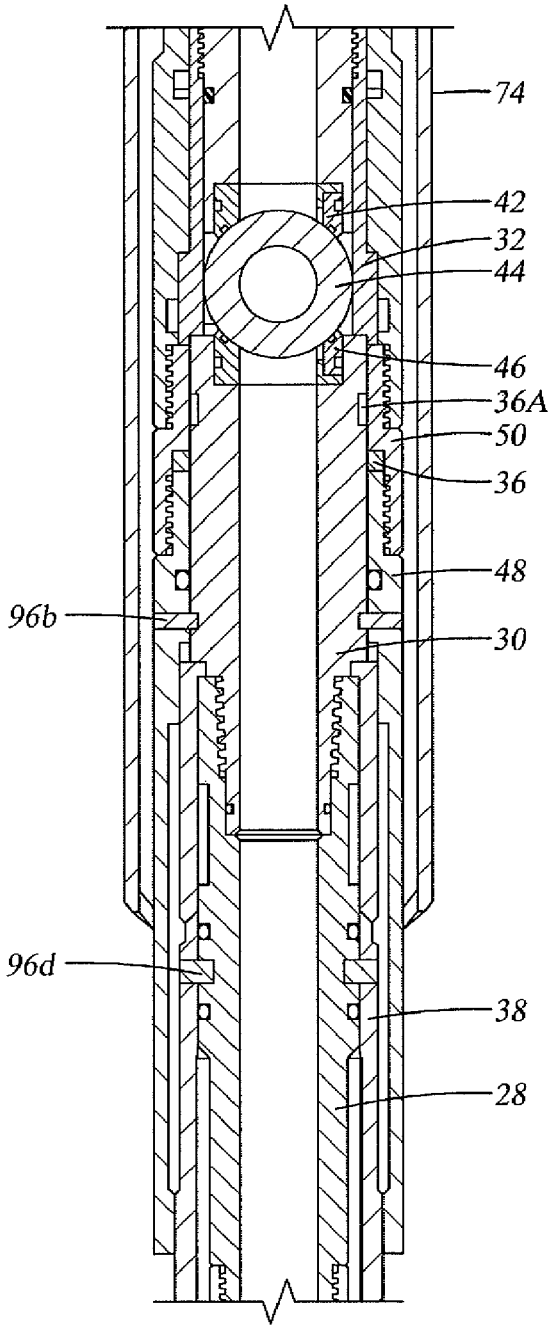
Figure 2C:
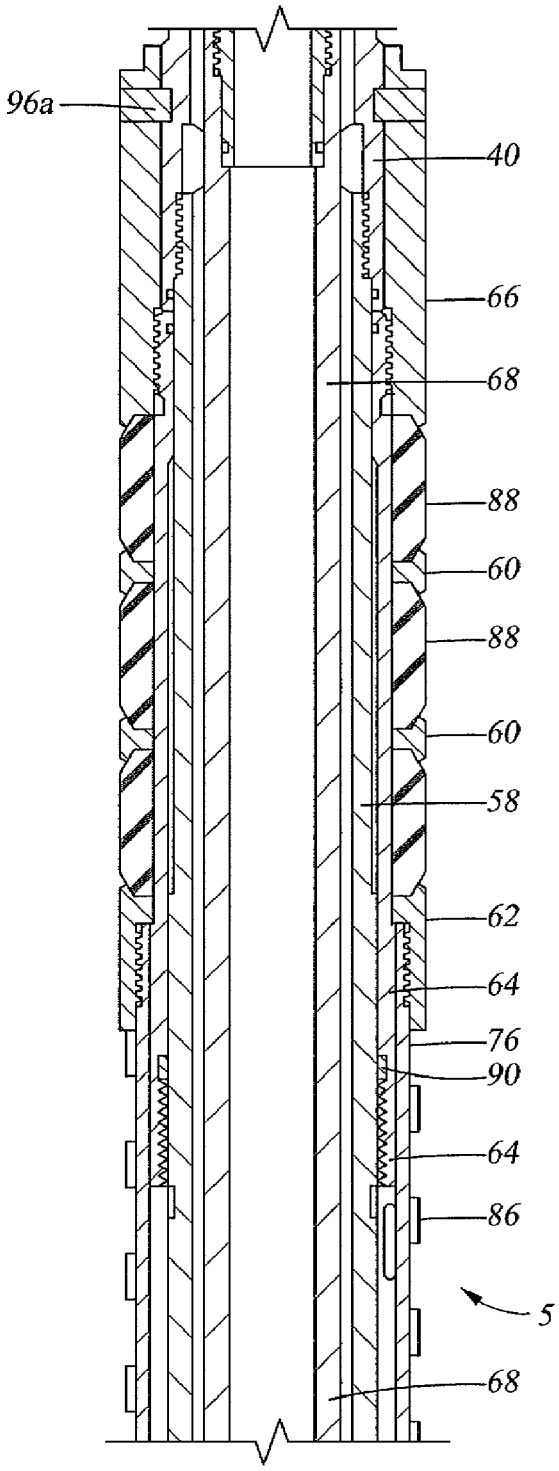
Figure 2D:
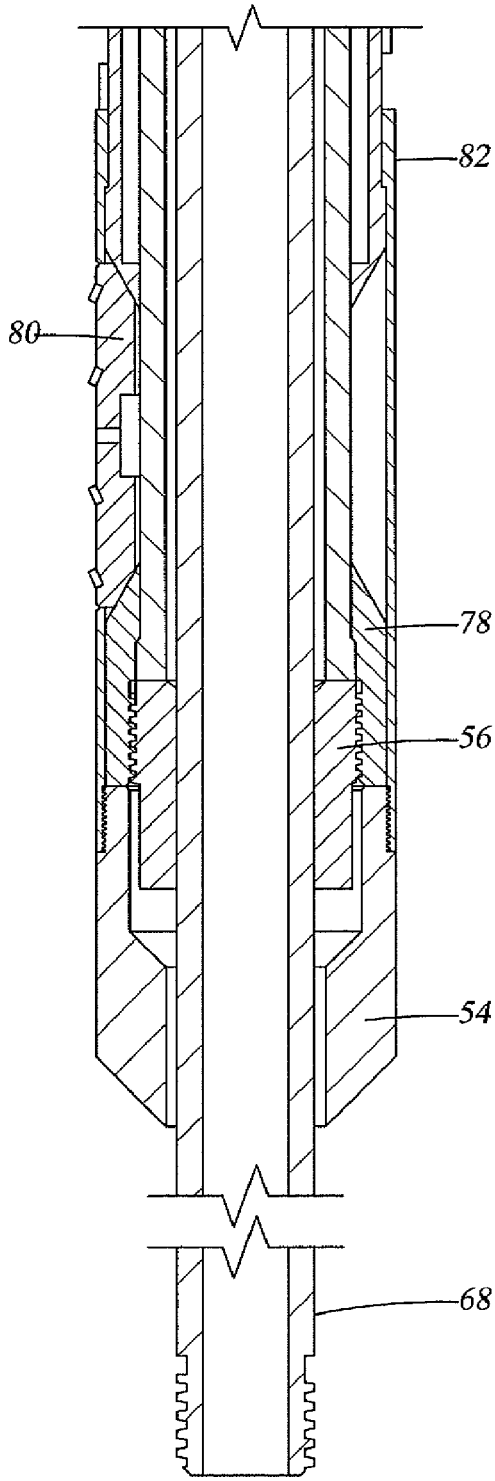

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a schematic illustration of wellbore plugs 10*a* and 10*b* of the present invention disposed in a wellbore 12. Wellbore 12 may be completed with casing 14. Perforations 16 may be formed through casing 14 before or after placement and setting of plugs 10. For example, a first plug 10*a* may be run into wellbore 12 and positioned for treating and/or perforating the first formation 18. After performing operations at the first formation 18, a second plug 10*b* may be run into wellbore 12 and set for conducting operations on second formation 20. This process may continue until the desired formations have been addressed.

Once operations are completed, retrieval of plugs 10 may commence. A workover rig or coiled tubing unit 19 is brought on site. Plugs 10 may be retrieved by conveyance 22 singularly or all in a single trip. Conveyance 22 is run into wellbore 12 with a retrieving head 24 and circulating to remove debris from wellbore 12. Retrieving head 24 is then connected to first plug 10*b*. Plug 10*b* is opened to allow circulation through plug 10*b*. Plug 10*b* may then be released from sealing connection with casing 14. Upon actuating plug 10*b* to the released and valve open position, plug 10*b* is locked in the open and released position. Plug 10*b* may then be conveyed down wellbore 12 and connected to plug 10*a*. The process of opening, circulating and releasing may be continued until all the plugs have been released. The multiple plugs 10 may then be retrieved from wellbore 12 without requiring multiple trips into wellbore 12. The ability to lock each plug in a valve open and sealing element retracted position facilitates the retrieval of multiple plugs in a single trip.

Referring now to FIG. 2, a cross-sectional view of an embodiment of multipurpose plug 10 is illustrated. Plug 10 comprises an elongated body, generally denoted by the numeral 5, that forms an internal bore 92 therethrough. Plug 10 includes a top valve seat 26, crossover sub 28, bottom valve seat 30, control finger 32, thread lock 34, clip ring 36, upper collet 38, lift ring 40, valve seat 42, ball valve 44, valve rotation pin 46, bottom skirt lock 48, spacer sub 50, upper valve body 52, cage bottom 54, bottom cone nut 56, lower collet 58, sealing element ring 60, bottom guide ring 62, sealing element sleeve 64, upper guide 66, lifting mandrel 68, retrieving head sub 70, retrieving head 72, wash sleeve 74, upper cone 76, lower cone 78, slip 80, slip cage 82, stand off pin 84, slip cage spring 86, casing to plug sealing element 88 and lock ring 90. Valve rotation pin 46 connects ball 44 and control finger 32 facilitating movement of ball 44 between the open and closed positions.

Thread lock 34, also referred to as a shear sub, includes shoulders 94 that are tapered to fit the stop on stand off pin 84. In the illustrated example the taper of shoulders 94 is forty-five degrees.

Sheer pins 96*a* are positioned between upper guide 66 and upper collet 38 to maintain plug 10 in the contracted, or run-in, position. Upon placement of plug 10 in the desired position, weight is applied to plug 10 shearing pins 96*a* and expanding elements 88 into sealing engagement with casing 14.

Stand off pin 84 is held in connection with retrieving head 72 via shear pins 96*c*, holding retrieving head 72 and wash sleeve 74 off of the valve assembly permitting circulation of fluid to clean the ball valve and assembly of well debris, for example fracturing sand, before opening the valve. By applying weight via conveyance 22 shear pins 96*c* part and retrieving head 72 moves down for connection to upper valve body 52 for retrieval of plug 10.

Bottom skirt lock 48 is connected to bottom valve seat 30 by sheer pins 96*b* that maintain the valve assembly (26, 30, 42, 44) in the closed position with ball 44 blocking fluid flow through bore 92 when in the run-in position. Tension applied to plug 10 will shear pins 96*b* moving valve 44 to the open position.

Clip ring 36 includes a face having a taper corresponding to the taper of a face of spacer sub 50. For example, the matching faces may be tapered at ten degrees. Thus, when tension is applied to plug 10, sub 50 urges clip ring 36 inward and into engagement with bottom valve seat 30 (e.g., groove 36A). This locking mechanism and method locks ball valve 44 in the open position and facilitates the ability to retrieve multiple plugs in a single trip.

Crossover sub 28 and upper collet 38 are connected to one another by shear pins 96*d*. Shear pins 96*d* anchor the members together so that sufficient tension may be applied to shift ball valve 44 to the open position. Upon application of sufficient tension the shear mechanism will be released and the valve assembly will be released from collet 38 and the valve assembly, crossover sub 28 and bottom collet 58 are moved up; bottom collet 58 is locked in cone 76. Slips 80 then retract allowing disengagement of sealing elements 88. Slip cage spring 86 then urges slip cage 82 into the released position.

With reference to FIGS. 1 and 2, a plug 10 is run into wellbore 12 with ball valve 44 in the closed position to the desired position in wellbore 12. Plug 10 is actuated expanding sealing elements 88 outward into sealing engagement with casing 14. Conveyance 22 may then be released from plug 10 for placement of additional plugs 10 or conducting wellbore operations. It is noted that conveyance 22 may be connected to and disconnected from retrieval head sub 70 or disconnection from plug 10 may be at the retrieval head sub 70 and retrieval head 72 connection.

When it is desired to retrieve plugs 10 a workover rig or coiled tubing unit 19 may be rigged up. Conveyance 22 is run into wellbore 12 circulating fluid to clean off the plug. Conveyance 22 is then connected to plug 10 via the retrieving head assembly. With wash sleeve 74 and the retrieval head held off of the valve assembly by stand off pin 84, circulation can continue to clean debris from valve 44.

Weight may then be applied to plug 10 via conveyance 22 parting pins 96*c* thereby moving retrieval head 72 down and into connection to upper valve body 52. Applying tension to plug 10 via conveyance 22 then actuates valve 44 to the open position and actuates the valve locking mechanism into the locked position holding valve 44 in the open position whether tension or weight is applied to plug 10. Further tension releases the sealing elements 88 from engagement with casing 14 and locks the sealing assembly including elements 88, slip cage 82, slip cage spring 86 into a retracted position. It is noted that circulation through plug 10 and the release and retrieval of plug 10 is accomplished without utilization of any J-slot device.

The upper most plug 10*b* may then be retrieved or run down wellbore 12 and connected to plug 10*a* for retrieval by repeating the above release and retrieval process. The present invention provides the ability to circulate through more than one plug and to retrieve more than one plug simultaneously.

From the foregoing detailed description of specific embodiments of the invention, it should be apparent that a multipurpose wellbore plug that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A method of retrieving at least a first plug and a second plug of the same type from a wellbore, wherein when the plugs are set in the wellbore each plug has a valve in a closed position blocking flow of fluid through the plug and a sealing mechanism expanded into engagement with a wellbore casing providing a seal between the plug and the casing, comprising:

connecting a conveyance to the first plug;

releasing the first plug by applying tension to the conveyance;

circulating fluid down through the conveyance and the first plug to the second plug;

moving the first plug into connection with the second plug without disconnecting the conveyance from the first plug;

releasing the second plug by applying tension to the conveyance, the first plug and the second plug; and retrieving the first plug and the second plug from the wellbore simultaneously.

2. The method of claim 1, wherein the releasing the plug further includes locking the valve of the plug in the open position, wherein the valve remains in the open position without tension or weight being applied to the plug.

3. The method of claim 2, wherein the locking the valve in the open position comprises urging a clip ring into connection with a valve seat.

4. The method of claim 1, wherein each of the releasing the plug includes:

locking the valve in the open position, wherein the valve remains in the open position without tension or weight being applied to the plug;

actuating the sealing mechanism to a retracted position by applying tension to the plug; and securing the sealing mechanism in the refracted position.

5. The method of claim 1, wherein the valve comprises a ball valve.

6. A method for retrieving multiple plugs from a wellbore, comprising:

running a conveyance into a wellbore to a first plug, the first plug comprising a seal element engaged with a wellbore casing and a valve blocking flow through a passage through the first plug;

connecting the conveyance to the first plug;

applying tension to the conveyance releasing the first plug from engagement with the casing and opening the valve in the first plug;

locking the valve in the first plug in the open position thereby allowing normal fluid circulation down through the conveyance and the first plug and reverse fluid circulation up through the first plug and the conveyance, wherein the locked valve remains in the open position without tension or weight being applied to the plug;

lowering the first plug via the conveyance into the wellbore toward a second plug, the second plug comprising a seal element engaged with the wellbore casing and a valve blocking flow through a passage through the second plug;

cleaning debris from the second plug by circulating fluid down through the conveyance and the first plug;

connecting the first plug and the second plug;

releasing the second plug from engagement with the casing by applying tension to the conveyance, the first plug and the second plug; and retrieving the first and the second plug from the wellbore simultaneously.

7. The method of claim 6, wherein the valves are ball valves.

8. The method of claim 6, further comprising prior to the retrieving the first and the second plug:

actuating a valve in the second plug to an open position;

locking the valve in the second plug in the open position thereby allowing normal fluid circulation down through the conveyance, the first plug, and the second plug and reverse fluid circulation up through the second plug, the first plug, and the conveyance; and circulating fluid through the conveyance, the first plug, and the second plug.

9. A method for retrieving more than one plug from a wellbore in a single trip, comprising:

running a conveyance into the wellbore to a first plug set in the wellbore;

circulating fluid down through the conveyance to the first plug to clean the wellbore;

connecting the conveyance to the first plug;

opening a passage through the first plug in response to actuating a first ball valve in the first plug from a closed position to an open position;

locking the first ball valve in the open position thereby allowing normal fluid circulation down through the conveyance and the first plug and reverse fluid circulation up through the first plug and the conveyance;

circulating fluid through the conveyance and the first plug;

releasing the first plug from engagement with the wellbore via the conveyance;

conveying the released first plug with the first ball valve in the locked open position via the conveyance to a second plug;

connecting the first plug to the second plug;

releasing the second plug from engagement in the wellbore; and retrieving the connected first plug and the second plug from the wellbore via the conveyance.

10. The method of claim 9, wherein the opening the first passage through the first plug is accomplished without utilizing a J-slot device.

11. The method of claim 10, wherein the releasing the first plug from engagement is accomplished without utilizing a J-slot device.

12. The method of claim 9, wherein the releasing the first plug from engagement with the wellbore comprises:

actuating a seal element of the first plug to a refracted position; and locking the seal element in the retracted position.

13. The method of claim 9, further comprising prior to the retrieving the first plug and the second plug:

opening a passage through the second plug in response to actuating a valve in the second plug from a closed position to an open position; and circulating fluid through the conveyance, the first plug, and the second plug.

14. The method of claim 13, further comprising locking the valve in the second plug in the open position, wherein the locked valve remains in the open position without tension or weight being applied to the second plug.

15. The method of claim 14, wherein the valve comprises a ball valve.

16. The method of claim 13, wherein:

the opening the passage through the first plug is accomplished without utilizing a J-slot device; and the opening the passage through the second plug is accomplished without utilizing a J-slot device.

17. The method of claim 9, wherein the locked first ball valve remains in the open position without tension or weight being applied to the first plug.

18. A method for running plugs in a wellbore, comprising:

running a lower plug on a first conveyance into the wellbore with a lower valve in a closed position blocking fluid flow through the lower plug;

setting the lower plug in the wellbore in response to actuating a sealing element into engagement with the wellbore wall;

retrieving the first conveyance from the wellbore;

performing an operation in the wellbore;

running an upper plug into the wellbore on the first conveyance with an upper valve in a closed position blocking fluid flow through the upper plug;

setting the upper plug above the lower plug in the wellbore in response to actuating a sealing element into engagement with the wellbore wall;

retrieving the first conveyance from the wellbore;

performing an operation in the wellbore;

running a second conveyance into the wellbore to retrieve the upper plug and the lower plug simultaneously;

connecting the second conveyance to the upper plug;

opening the upper valve and locking the upper valve in the open position by applying tension to the second conveyance, wherein the upper valve remains open without tension or weight being applied to the upper plug;

circulating fluid down through the second conveyance and the upper plug;

releasing the upper plug from engagement with the wellbore wall by applying tension to the second conveyance;

lowering the upper plug on the second conveyance to the lower plug;

connecting the upper plug to the lower plug;

releasing the lower plug from engagement with the wellbore by applying tension to the second conveyance; and retrieving the upper plug and the lower plug simultaneously on the second conveyance.

19. The method of claim 18, further comprising:

opening, prior to the retrieving, a lower valve in the in lower plug by applying tension to the second conveyance; and circulating, prior to the retrieving, drilling fluid through the second conveyance, the first plug, and the second plug.

* * * * *